United States Patent [19]

Heiller et al.

[11] Patent Number: 4,862,225

[45] Date of Patent: Aug. 29, 1989

[54] POWER SUPPLY SEQUENCING CIRCUIT FOR FLASH FUSER

[75] Inventors: Glenn H. Heiller, Minnetonka; Michael P. Petersen, Eagan, both of Minn.

[73] Assignee: Check Technology Corporation, Eagan, Minn.

[21] Appl. No.: 170,923

[22] Filed: Mar. 21, 1988

[51] Int. Cl.[4] ..... G03G 15/00; H05B 1/00; H05B 3/02

[52] U.S. Cl. ..... 355/288; 219/216; 219/482; 219/486; 355/282

[58] Field of Search ..... 355/3 FU, 14 FU; 219/216, 388, 483, 486; 250/317.1, 318, 319; 315/241 S, 241 P; 307/596

[56] References Cited

U.S. PATENT DOCUMENTS

| | | | |
|---|---|---|---|
| 3,445,626 | 5/1969 | Michaels . | |
| 3,871,761 | 3/1975 | Mabrouk . | |
| 4,121,888 | 10/1978 | Tomura et al. . | |
| 4,183,654 | 1/1980 | Waschk et al. . | |
| 4,386,840 | 6/1983 | Garthwaite et al. . | |
| 4,434,353 | 2/1984 | Marsh et al. | 355/3 FU X |

FOREIGN PATENT DOCUMENTS

| | | | |
|---|---|---|---|
| 0136072 | 8/1983 | Japan | 355/14 FU |
| 0033478 | 2/1984 | Japan | 355/14 FU |
| 0128477 | 7/1985 | Japan | 355/3 FU |
| 0237481 | 11/1985 | Japan | 355/3 FU |
| 0200567 | 9/1986 | Japan | 355/3 FU |

*Primary Examiner*—A. T. Grimley
*Assistant Examiner*—Edward J. Pipala
*Attorney, Agent, or Firm*—Orrin M. Haugen; Thomas J. Nikolai; Frederick W. Niebuhr

[57] ABSTRACT

A fusing system for a xerographic printer in which the energy from a plurality of flash lamps is used to melt and fuse toner particles to paper sheets as said sheets travel through the fusing station. Each flash lamp has an associated storage capacitor and a charging circuit for that capacitor which is operative to develop a charge on its associated storage capacitor depending upon the length dimension of the paper sheets flowing through the system. Moreover, the capacitor charging circuits are rendered operative in a predetermined serial order so as not to unduly load down the alternating current source for the system. A lamp triggering circuit synchronized with the zero-crossings of the alternating current supply voltage provides the ignition potential for the flash lamps such that firing takes place at a time when the supply voltage is at a minimum.

6 Claims, 4 Drawing Sheets

POWER SUPPLY SEQUENCING CIRCUIT FOR FLASH FUSER

BACKGROUND OF THE INVENTION

I. Field of the Invention

This invention relates generally to xerographic printing apparatus, and more particularly to an improved flash fusing system for adhering toner particles to a developed image as the sheets pass through the printing system.

II. Discussion of the Prior Art

In prior art xerographic printing systems, a toner consisting of a powdered composition of resins, plasticizers and pigment is electrostatically deposited on an imaging drum and then transferred to a paper sheet. The toner is then fixed with pressure or in a fusion process whereby the toner particles become bonded to the paper sheet. One way to fix the toner is to expose the sheet containing the toner image to radiation energy produced by one or more flash lamps. Xenon flash lamps have proven to be highly suited to the flash fusion operation in that they can produce a high intensity flash and may repeatedly be operated without loss of radiation energy output. Further background concerning the process of flash fusing toner in xerographic printers may be obtained from Marbrouk U.S. Pat. Nos. 3,871,761 and from Garthwaite et al. 4,386,840.

When it is considered that many printing systems must accommodate paper sheets ranging in size from 6 to 8½ inches in width and from 3 to 16 inches in length, to minimize peak power requirements, it is desirable to control the number of lamps being flashed at the fusion station as a function of paper length. Large sheets, e.g., 8½×16 in. sheets require more energy per sheet to accomplish indelible fusion of the toner. This can be accomplished by including multiple lamps in the fusing station. With larger sheet sizes, the charging circuit for the flash lamps have more time in which to function. With smaller sheet sizes, less energy per sheet is required, but the flash rate must be greater to accommodate the increased flow rate in terms of sheets per unit of time. In conserving peak power, it is desirable to take the maximum time possible for charging the flash lamps, energy storage capacitors to the firing potential for the desired paper size and flow rate.

SUMMARY OF THE INVENTION

In accordance with the present invention, there is provided at the fusing station a plurality of parallelly disposed flash lamps extending transverse to the direction of paper flow. The number of lamps employed is determined by the maximum paper length which the printing system can accommodate. Associated with each of the flash lamps is an energy storage capacitor or capacitor bank, each with its own independent charging circuit. Each of the charging circuits includes a voltage doubling network connected between the AC supply mains and the capacitor bank and a control switch. The control switch for each of the charging circuits is, in turn, connected to the output of a coincidence gate whose inputs come from a sequencer and from a programmable register. The sequencer is driven by the output from a zerocrossing detector which is also coupled o the AC supply lines and, as a result, only the preselected ones of the capacitor bank charging circuits will be activated, with the activation occurring in a predetermined sequential order.

The flash lamp control circuit of the present invention further includes a lamp triggering circuit for each of the flash lamps used in the system which simultaneously delivers to all lamps a voltage sufficiently high to trigger conduction by way of a plasma breakdown. However, only those lamps whose capacitor banks have been previously charged will flash. Circuitry is also provided to insure that the ignition pulse is not applied to the lamps when the AC supply voltage is other than zero. This significantly reduces EMI noise radiation.

OBJECTS

It is accordingly a principal object of the present invention to provide an improved flash fusion system for xerographic printing apparatus.

Another object of the invention is to provide a flash lamp control circuit which functions to reduce the average peak power requirements.

Yet another object of the invention is to provide an electronic control system for flashing lamps in which the number of lamps simultaneously energized is determined as a function of the size of the paper being transported through the printing system.

A yet further object of the invention is to provide a capacitor bank charging circuit for use with a plurality of xenon flash lamps wherein the individual charging circuits are activated in a predetermined serial order.

These and other objects and advantages of the invention will become apparent to those skilled in the art from the following detailed description of a preferred embodiment, especially when considered in conjunction with the accompanying drawings.

Figure 2:
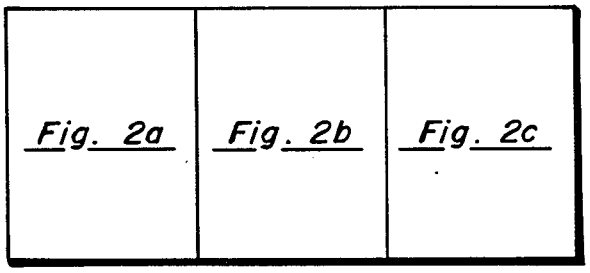

2*a*, 2*b* and 2*c*, when arranged as in as in FIG. 2, show an electrical schematic diagram of the preferred embodiment of the present invention.

DESCRIPTION OF THE PREFERRED EMBODIMENT

Figure 1:
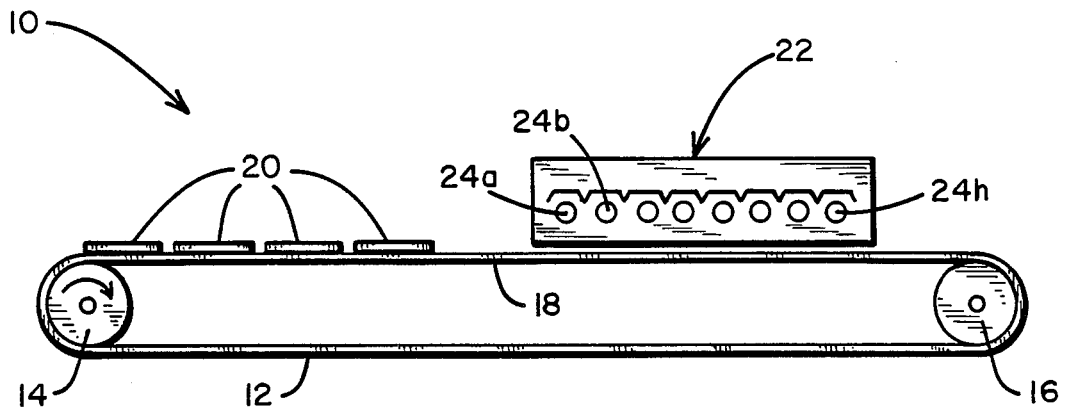
FIG. 1 is a mechanical schematic diagram of a portion of a xerographic printer showing a multi-lamp fusing station.

Referring first to FIG. 1, there is shown a conveyor system, indicated generally by numeral 10, and including an endless belt 12 surrounding a drive pulley 14 and an idler pulley 16 so as to define an upper flight 18 used to transport a plurality of paper sheets 20 from a toner applying station (not shown) to a flash fuser station indicated generally by numeral 22. Disposed within the flash fusing station 22 is a plurality of flash lamps 24*a* through 24*h*. The lamps are preferably of the xenon flash type and are oriented with their longitudinal axes parallel to one another and extending transverse to the direction of paper flow. The flash lamps are mounted in suitable reflectors for deflecting and spreading the radiant energy produced thereby uniformly onto the paper sheets 20 as they pass through the fusing station 22.

It is contemplated that the apparatus of FIG. 1 can accommodate printing on sheets of differing length and width dimension. As will be explained in greater detail below, the number of lamps which are to be fired depends upon the length dimension of the paper sheet being processed. Where, for example, 8½×16 in. paper is involved, all of the lamps 24*a*through through 24*h* will be fired simultaneously. However, when shorter sheets, e.g., 3 in. long sheets, are employed, only lamps 24*a* and 24*b* need be fired to provide the requisite energy to effect satisfactory toner fusion. Paper sheets of intermediate size will dictate that more than two, but less than all of the lamps illustrated need be flashed. In each case, the flash is made to occur when the, trailing edge of a sheet reaches the same physical location within the fusing station.

Figure 2A:
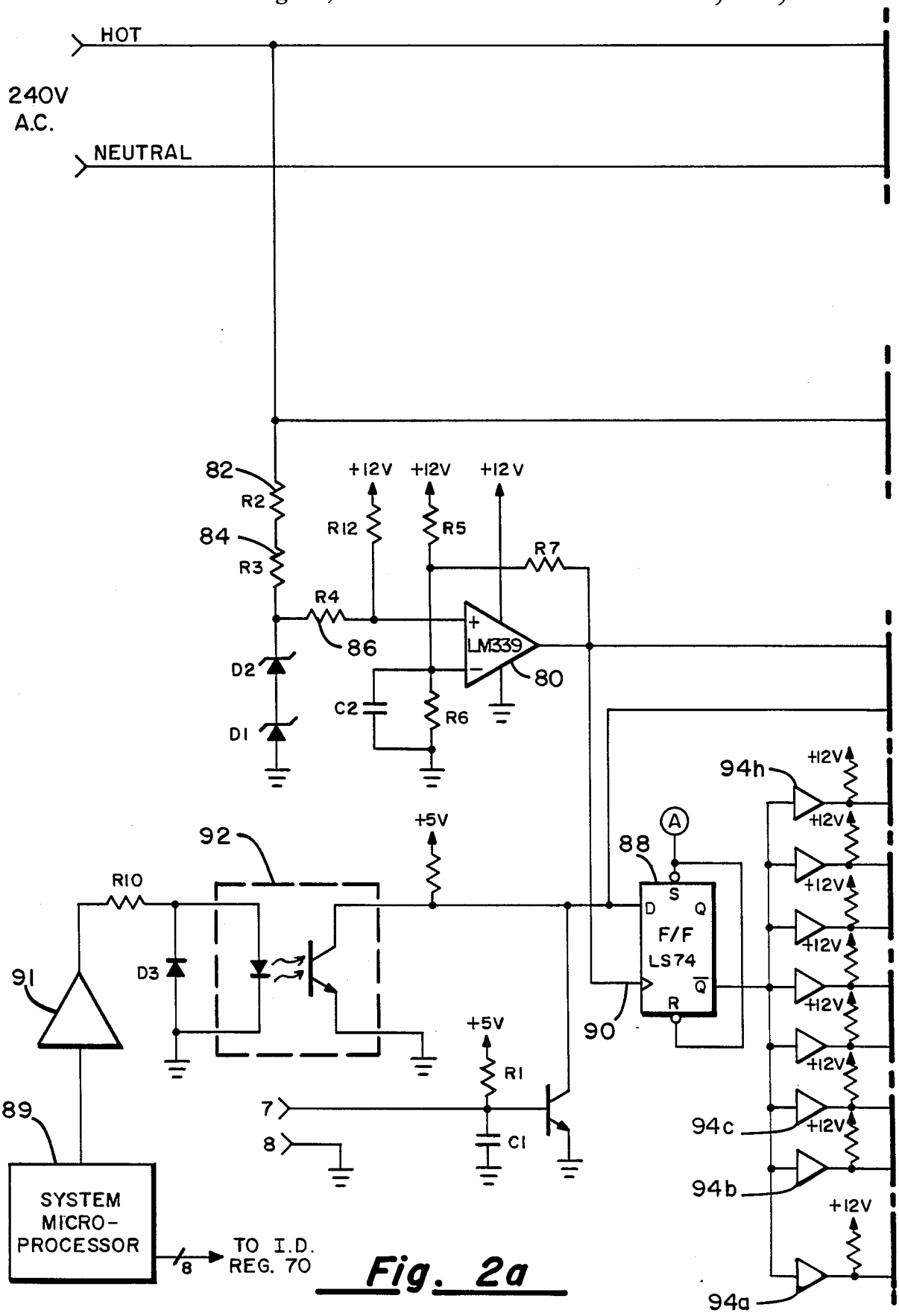
Figure 2B:
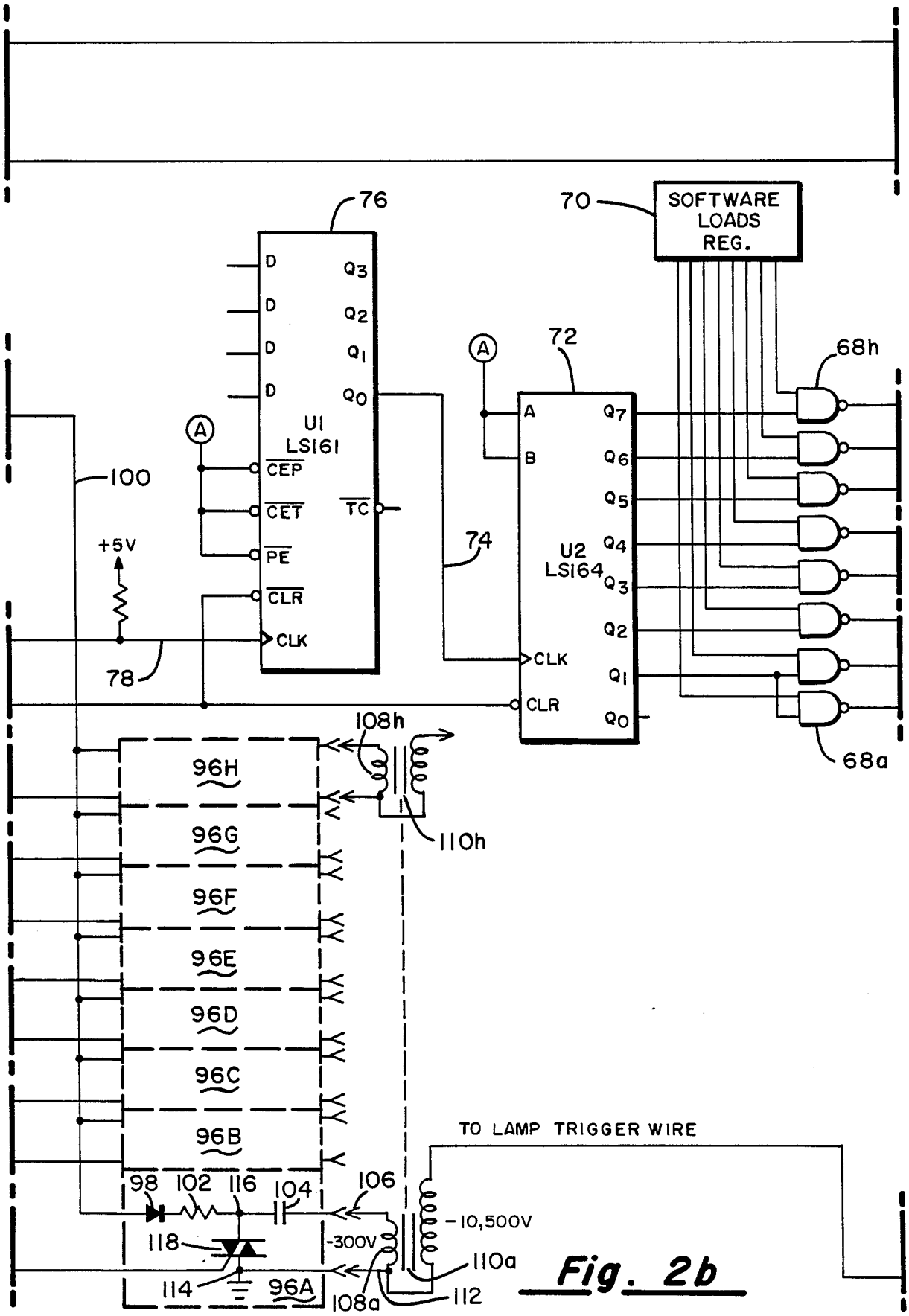
Figure 2C:
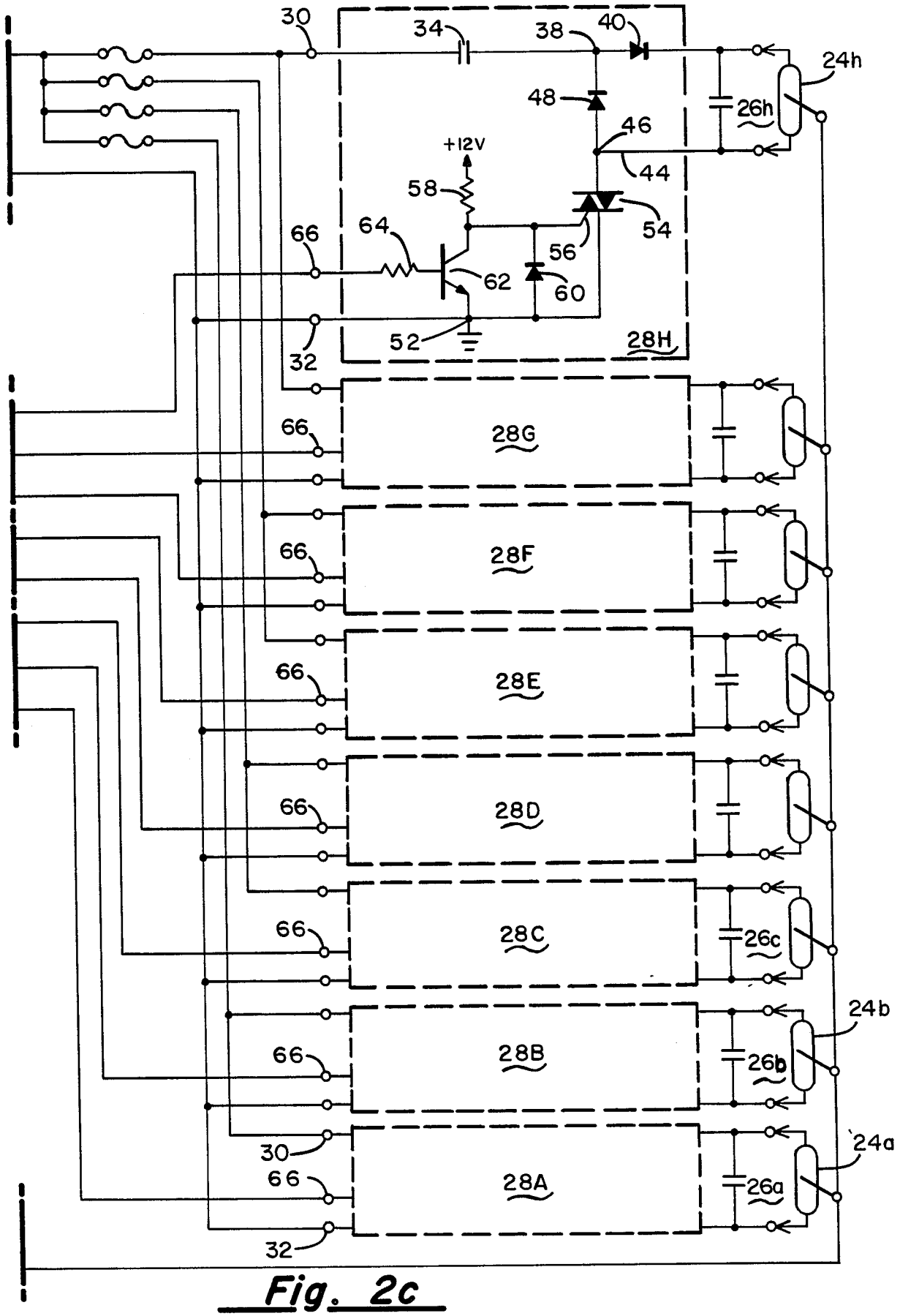

Now that the general organization of the mechanical arrangement has been explained, consideration will next be given to the charge/discharge control circuit for the flash lamps and, in this regard, reference is made to the electrical schematic diagram of FIGS. 2*a* through 2*c*. As is indicated at the right side of the drawing, the flash lamps 24*a* ,through 24*h* are each arranged to be connected directly across, its own capacitor bank, such as banks 26*a* through 26*h*. Associated with each of the capacitor banks is a capacitor bank main charging circuit which are labeled 28A through 28H, respectively. Each of the capacitor bank main charging circuits is identical in its implementation to that which is shown in full and identified by numeral 28H. That is, each includes a pair of input terminals 30 and 32 which are adapted to be connected to an alternating current power supply, such as a 240 volt 60 Hz line voltage source. Each of the main charging circuits 28A through 28H includes a voltage doubler network, including a capacitor, as at 34, connected in series between the input terminal 30 and a junction point 38. Connected between junction point 38 and the capacitor bank 26h is a series connected diode, as at 40. The other terminal of the capacitor bank 26*h* is connected by a conductor 44 to a junction point 46 and a further diode 48 is connected in series to junction point 38. Input terminal 32 is grounded at junction 52 and a triac switch 54 connects between that junction and junction point 46. The trigger electrode 56 of the triac 54 is connected through a bias resister 58 to a source of direct current bias potential, e.g., +12 volts. Disposed between the trigger electrode 56 of the triac 54 and the ground junction 52 is a parallel combination including a diode 60 and a transistor 62. The base or control electrode of transistor 62 is coupled through a resister 64 to a control input terminal 66 of the capacitor bank charging circuits 28A–28H.

Associated with each of the control input terminals 66 for the individual capacitor bank charging circuits 28A through 28H is a NAND gate, respectively labeled 68A through 68H. Likewise, each of these gates has a pair of inputs, one originating at the output of a multistage I.D. (identification) register 70 and the other originating at the output of a sequencer circuit 72.

The sequencer circuit 72 may comprise an 8-bit serial in/parallel out integrated circuit shift register which, when clocked by pulses on the clock line 74, causes a bit to shift from one stage output to the next. The clock line 74 for the shift register 72 comes from the stage 1 output of a synchronous presettable counter chip 76 which, in turn, is arranged to be clocked by pulses occurring on line 78 emanating from the output of a zero-crossing detector circuit 80.

The zero-crossing detector has its input connected to the 240 volt AC supply, via current limiting resisters 82 and 84, and coupling resister 86. The circuit 80 is configured to produce clock pulses on line 78 at each excursion of the 60 Hz voltage through its zero amplitude reference level. The output from the zero-crossing detector is also applied to the clock input of a D-Type flip-flop 88, via conductor 90. The data input, D, of flip-flop 88 is coupled by means of an opto-isolator circuit 92 to a source of "fire" pulses which, typically, will originate at the microprocessor 89 which use to control the overall operation of the printing system. It is this same microprocessor which is used to load the I.D. register 70 with information indicating which of the capacitor bank charging circuits is to be enabled and this will be based upon the size of the paper sheets being utilized, all as will be more fully described hereinbelow.

The complimentary output of the flip-flop 88 is simultaneously applied, via driver circuits 94*a* through 94*h*, to the trigger input terminals of lamp ignition circuits 96A through 96H. Referring to the circuit 96A, each of the lamp ignition circuits is seen to include a diode 98 whose anode is connected by a conductor 100 to the 240 volt AC supply and whose cathode is connected through a timing resister 102 and a capacitor 104 to a jack 106 to which the primary winding 108 of a step-up transformer 110 is connected. The other terminal 112 of the primary winding connects to a grounded junction 114 and connected between that junction and the junction 116 between the resister 102 and the capacitor 104 is a triac 118. The trigger input of the triac 118 is connected to the output of the driver 94*a*. The step-up ratio of the transformer 110 may be about 35:1.

Having described the make-up of the flash lamp control circuit in detail, consideration will next be given to its mode of operation. First, let it be assumed that relatively long sheets of paper are being processed through the printer apparatus such that all eight of the flash lamps 24*a* through 24*h* are to be fired for the purpose of effecting fusing of the toner to the paper. All of the triacs corresponding to triac 54 in charging circuit 28H are initially conducting so that a charging current flows from the 240 volt AC supply to first charge-up the capacitor 34 during a first 180 portion of the sinusoidal wave. During the succeeding half cycle, the voltage on the capacitor 34 adds to the supply voltage in charging the capacitor bank 26*h* so that voltage doubling effectively takes place.

A charging current also flows through the conductor 100 and the components 98, 102 and 104 of each of the triggering circuits 96A through 96H and through the primary winding of the transformers 110 to charge the capacitors 104. Now, when the microprocessor 89 determines that the trailing edge of a toner bearing sheet has entered the fusing station, it applies a fire pulse, via the buffer circuit 91 and the opto-coupler 92, to the data input of D-Type flip-flop 88. This flip-flop will not shift state, however, until the next subsequent zero-crossing of the applied AC line voltage. At the same time that the firing pulse is applied to the flip-flop 88, the charging circuit is disabled by the "clr" signal input to the counter 76 and the shift register 72. At the next zero-crossing, the $\overline{Q}$ output from the flip-flop 88 simultaneously triggers each of the triacs 118, via the driver circuits 94*a* through 94*h*. This serves to turn on the corresponding triac allowing all of the capacitors 104 to discharge through the primary winding 108 of each of their respective step-up transformers 110. This causes a substantial voltage, e.g., about 10,500 volts, to be applied to the trigger terminals of each of the flash lamps 24*a* through 24*h*. This voltage causes ionization to take place within the tubes creating a low impedance plasma discharge path therethrough whereby the capacitor banks 26*a* through 26*h* discharge through their associated flash tube creating the high intensity energy output therefrom.

When the fire pulse is removed by the microprocessor 89, on the next subsequent zero-crossing of the applied AC voltage, the flip-flop 88 will be cleared, causing each of the triacs 118 to shift to its non-conducting state, whereby all of the capacitors 104 in the individual lamp trigger-pulse charging circuits 96A through 96H will recharge.

Also, it is to be noted that when the microprocessor generated fire pulse is removed, the "clear" signals (CLR) are removed from the four-stage synchronous counter 76 and from the eight-stage shift register 72. Because of the frequency division provided by the counter 76, clock pulses will appear on conductor 74 only after two zero-crossings of the applied AC voltage have taken place. Thus, after four zero-crossings have taken place, stage 1 of the shift register 72 will output a signal to the gate 68*a*. In that it has been assumed that all lamps 24*a* through 24*h* are to be activated, the I.D. register 70 will have been loaded with all 1's by the microprocessor controller and, as a result, the circuits 28A and 28B will have their triacs 54 turned on to permit charging of the capacitor banks 26*a* and 26*b*.

Two clock pulses later, the shift register 72 will have stage Q2 thereof active, allowing the capacitor bank 26*c* to next charge up. In a similar fashion, every succeeding two zero-crossings of the applied AC waveform will result in the shift register advancing one stage, whereby capacitor banks 26*d*, 26, 26*f*, 26*g*, 26*h* will be sequentially charged in that order.

If it is assumed that shorter sheets of paper are involved, the microprocessor 89 is effective to load I.D. register 70 with a pattern of 1's and 0's so that only selected ones of the NAND gates 68A through 68H will be partially enabled. Only those gates that have been partially enabled are capable of producing an output when the shift register 72 provides the second input to those gates. As such, only selected ones of the charging circuits 28A through 28H will be allowed to charge up its associated capacitor bank 26*a* through 26*h*. While the circuits 96A through 96H simultaneously apply ignition potentials to all of the lamps, only those lamps whose associated capacitor bank 26*a*–26*h* have been charged will flash.

It can be seen, then, that the amount of power drawn from the AC mains to charge up the capacitor banks 26*a* through 26*h* is selectable as a function of paper size and the capacitor banks are allowed to charge sequentially. Moreover, in that the flip-flop 88 only produces an output at the time of a zero-crossing of the applied AC voltage, the triggering of the lamps occurs only at a time when the applied AC voltage is zero. As such, this tends to limit noise in the form of electro-magnetic radiation. This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. A circuit for controlling the operation of a plurality of flash lamps used to fuse toner particles to paper sheets in a xerographic printing system wherein the number of lamps energized is dependent upon the side of said paper sheets, comprising:

(a) a plurality of flash lamps positioned orthogonally to the direction of flow of said paper sheets through said xerographic printing system;

(b) at least one energy storage capacitor operatively and individually coupled to each of said flash lamps;

(c) capacitor charging circuit means, each including electronic switch means disposed in series between said energy storage capacitors for each of said flash lamps and a source of alternating current voltage;

(d) sequencing means for producing control signals for turning on said electronic switch means in said capacitor charging circuit means at predetermined discrete sequential time intervals whereby said energy storage capacitors are connected said charging circuits means in a timed sequence, said sequencing means including (i) a zero-crossing detector circuit coupled to said source of alternating current voltage for producing clocking pulses at each zero-crossing of said alternating current voltage;

(ii) frequency dividing means coupled to the output of said zero-crossing detector circuit; and (iii) shift register means coupled to the output of said frequency divider means for generating said control signals in a predetermined time serial order (e) gating means coupled to receive said control signals and capacitor circuit identification signals for selectively applying said control signals to said electronic switch means only in particular identified ones of said capacitor charging circuit means; and (f) trigger means for simultaneously applying a flash lamp triggering signal simultaneously to all of said flash lamps whereby only whose flash lamps identified by said charging circuit identification signal will be flashed.

2. The circuit as in claim 1 wherein said gating means are coupled to the outputs of said shift register means.

3. The circuit as in claim 1 wherein said trigger means includes means coupled to said zero-crossing detector circuit for applying a predetermined firing potential to said plurality of flash lamps.

4. The circuit as in claim 3 wherein said means coupled to said zero-crossing detector circuit comprises:

(a) half-wave rectifier means coupled to said source of alternating current voltage;

(b) capacitor means coupled to said half-wave rectifier means for storing a direct current potential;

(c) step-up transformer means having a primary winding with a pair of input terminals, one of said pair of said input terminals connected to said capacitor means; and (d) semiconductor switching means for selectively discharging said capacitor means through said primary winding of said step-up transformer.

5. The circuit as in claim 4 wherein the secondary winding of said step-up transformer means connects to said flash lamps

6. In a xerographic print reproducing system of the type in which toner particles are transferred from an electrostatic image carrying medium to paper sheets, an improved apparatus for fusing said toner particles to said paper sheets, comprising:

(a) a toner fusing station including a plurality of flash lamps arranged in parallel spaced relation transverse to the paper flow path through said printing system;

(b) an energy storage capacitor coupled individually to each of said flash lamps;

(c) a source of alternating current voltage;

(d) capacitor charging means coupled to said source of alternating current voltage and individually associated with each of said energy storage capacitors;

(e) control means coupled to said capacitor charging means for charging a predetermined number of said energy storage capacitors, the number being determined by the length of the paper sheets passing along said paper flow path, said control means including sequencing means for causing said predetermined number of energy storage capacitors to be charged in a predetermined sequential order; and (f) means for simultaneously discharging all of said energy storage capacitors through its respective flash lamp at an instant when said alternating current voltage is zero.

* * * * *

UNITED STATES PATENT AND TRADEMARK OFFICE

CERTIFICATE OF CORRECTION

PATENT NO. : 4,862,225

DATED : August 29, 1989

INVENTOR(S) : Glenn H. Heiller and Michael P. Petersen

It is certified that error appears in the above-identified patent and that said Letters Patent is hereby corrected as shown below:

Column 6, line 1, "side" should read -- size --. Line 17, insert "to" after "connected". Line 39, "whose" should read -- those --.

Signed and Sealed this

Twenty-sixth Day of March, 1991

*Attest:*

HARRY F. MANBECK, JR.

*Attesting Officer*

*Commissioner of Patents and Trademarks*